US006792887B1

(12) United States Patent
Baker

(10) Patent No.: US 6,792,887 B1
(45) Date of Patent: Sep. 21, 2004

(54) PORTABLE AND STOWABLE STEP FOR WATER-BORNE VESSEL

(75) Inventor: Stephen J. Baker, Orange Beach, AL (US)

(73) Assignee: Blue Splash, Inc., Birmingham, AL (US)

( * ) Notice: Subject to any disclaimer, the term of this patent is extended or adjusted under 35 U.S.C. 154(b) by 0 days.

(21) Appl. No.: 10/684,848

(22) Filed: Oct. 14, 2003

(51) Int. Cl.[7] ..... B63B 17/00
(52) U.S. Cl. ..... 114/362; 182/196
(58) Field of Search ..... 114/362; 182/196

(56) References Cited

U.S. PATENT DOCUMENTS

| | | | |
|---|---|---|---|
| 2,651,789 | A | 9/1953 | Newland |
| 2,975,858 | A | 3/1961 | Billingsley |
| 4,926,965 | A | 5/1990 | Fox |
| 4,986,785 | A | 1/1991 | Flowers |
| 5,074,236 | A | 12/1991 | Robertson |
| 5,542,369 | A | 8/1996 | Ingram |
| 5,704,447 | A | 1/1998 | Doyle |
| 5,848,667 | A | 12/1998 | Davidson |
| 6,343,562 | B1 | 2/2002 | Ingram |
| 6,464,038 | B1 | 10/2002 | Park |
| 6,533,626 | B2 | 3/2003 | Pons |
| 2002/0119715 | A1 | 8/2002 | Pons |

*Primary Examiner*—Jesus D. Sotelo
(74) *Attorney, Agent, or Firm*—Bradley Arant Rose & White LLP

(57) ABSTRACT

A stowable and extendable step to facilitate entry by a person into a vessel from the water is disclosed. One embodiment comprises a support that may act as a handle and a step, a strap, the lower end of which is attached to the support, and a keeper comprising a substantially planar, foldable piece of material. The upper end of the strap is attached to the vessel, either directly or indirectly. The keeper has upper and lower areas, each with releasable fasteners (such as Velcro) on at least a portion of its perimeter, the fasteners on the upper area complementary to and interlocking with those on the lower area. The lower area of the keeper may thus be folded up and into contact with the upper area, forming an enclosure. The strap is gathered inside said enclosure, with the end attached to the handle extending from the upper junction of the upper and lower areas, such that the handle when pulled will cause the strap to extend and enclosure to open.

27 Claims, 3 Drawing Sheets

PORTABLE AND STOWABLE STEP FOR WATER-BORNE VESSEL

BACKGROUND

The present invention provides a lightweight, stowable and extendable step to allow easy entry into a vessel by a person in the water. The invention is discussed and illustrated with respect to kayaks, but it may be used with virtually any water-borne vessel to which it may be secured.

Persons involved in sea kayaking, canoeing, sailing, or other boating activities may fall into the water, either intentionally or unintentionally. Depending on the conditions, such as current, wave level, water temperature, weather, and the like, it may be difficult to re-enter the vessel, and for some people with physical restrains or handicaps, or wearing heavy clothing or shoes, re-entry under any conditions may be difficult. Difficulty in re-entering a vessel from the water poses a safety issue and discourages some people from participating in these activities altogether.

A simple device to allow re-entry of a vessel from the water is needed. The device should satisfy various requirements of the marine environment and of the particular application in which it is used. For example, it must be durable and capable of withstanding water and sun. It should be stowable and secure, so that it does not interfere with other activities or objects on the vessel, such as paddling or lines and ropes on and extending from the vessel (e.g., ski ropes, anchor lines, fishing lines, etc.). It ought to be adjustable in length and attach to a variety of vessels, and it would also be advantageous if the device were lightweight, relatively inexpensive, and easy to use.

The embodiments of the present invention, as described and claimed herein, satisfy these needs and provide a stowable and extendable step that may be attached to virtually any vessel and which allows easy re-entry from the water into the vessel. The device thus increases safety and encourages participation in and the enjoyment of boating activities.

SUMMARY

One embodiment of the invention comprises a support that may act as both a handle and a step, a strap with an upper end and a lower end, with the lower end of the strap attached to the support, and a keeper comprising a substantially planar foldable piece of material having an upper area and a lower area. The keeper further comprises a slot in the upper area, with the upper end of the strap extending through the slot for attachment to the vessel, either directly or indirectly and releasable fasteners such as Velcro attached to at least a portion of the perimeter of the upper and lower areas. The fasteners on the upper area are adapted to interlock with those on the lower area. In this way, the keeper may be folded, bringing the lower fasteners into contact with the upper fasteners. The interlocked fasteners and the fold thus formed at the bottom of the keeper make an enclosure in which the strap may be gathered with the support hanging from the upper junction where the upper and lower areas meet. Pulling on the support will cause the strap to extend from the enclosure and the enclosure to open.

The keeper, strap and support may be brightly colored and include reflective highlights. They are made from any suitably durable material, which can withstand prolonged exposure to water and sun. In a preferred embodiment, the support is a rigid handle that floats, and the strap has quick-release buckles and means to adjust its length. Instructions may be printed on or otherwise attached to the keeper. The upper end of the strap may be attached to loop on the keeper to which a clasp is also attached, and the clasp is in turn secured to the vessel. Alternatively, the strap may be secured directly to the keeper, and the keeper is attached to the vessel via a clasp or similar means.

DESCRIPTION OF DRAWINGS

These and other features, aspects, structures, advantages, and functions are shown or inherent in, and will become better understood with regard to, the following description and accompanied drawings where.

DETAILED DESCRIPTION

Figure 1:
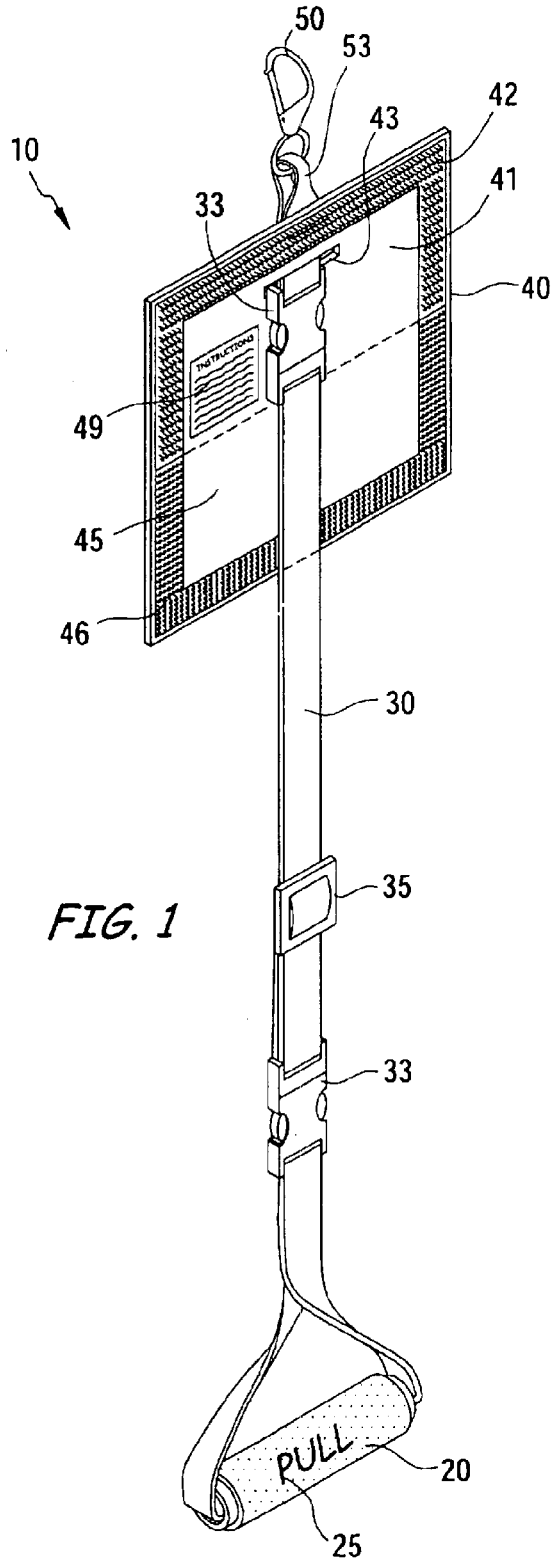
FIG. 1 is a perspective view of one embodiment of the present invention, with the strap extended and the keeper in an open configuration.

As shown in FIG. 1, one embodiment of a stowable and extendable step 10 comprises a support 20 (which may act both as a handle and a step and is generally referred to herein as the step), a strap 30, the lower end of which is attached to the step 20, and a piece of foldable material 40 which acts as a keeper for the strap 30. The upper end of the strap 30 is attached to the vessel, directly or indirectly.

The keeper 40 comprises a slot 43, through which the strap 30 passes. The keeper 40 also comprises complementary releasable fasteners 42 and 46, such as Velcro, placed along at least a portion of its perimeter. The keeper 40 may be viewed as having an upper area 41 and a lower area 45, with the fasteners 42 on the upper area being complementary or interlocking with the fasteners 46 on the lower area 45. In this way, the keeper 40 serves as an enclosure when the lower area 45 is folded up and into contact with the upper area 41, such that the interlocking fasteners 42 and 46 engage and secure the keeper in the enclosed configuration shown in FIG. 2.

Figure 2:
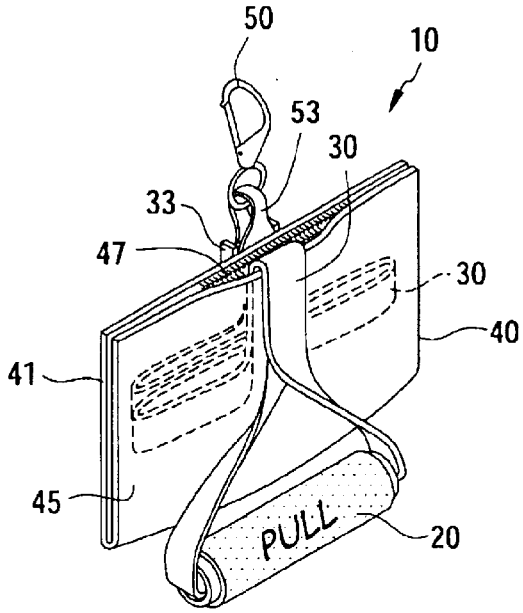
FIG. 2 is the embodiment of FIG. 1 with the strap and the keeper in a closed, stowed configuration.

In use, the strap 30 is coiled or gathered and held adjacent to keeper 40, in its open configuration, and then the keeper 40 is folded as described above to form an enclosure holding the strap 30 in a retracted configuration inside, as shown in FIG. 2. The end of strap 30 attached to the step 20 extends through the upper junction 47 of the now-interlocked upper and lower areas of the keeper 40, such that the step 20 hangs just on the outside of the keeper. When the step 20 is pulled, the strap 30 extends and the keeper 40 opens.

The other end of the strap 30 is attached to the vessel either directly or indirectly. The end of the strap may extend through the slot 43 and be secured to the vessel via the clasp 50, which may be secured to rigging, an eyelet, a cleat, a tie-down or other securing means on a vessel. The strap 30 may be attached to the vessel via a loop 53 (as shown) or similar device attached to keeper 40, which also is attached to clasp 50, which may be secured to the vessel.

Figure 5:
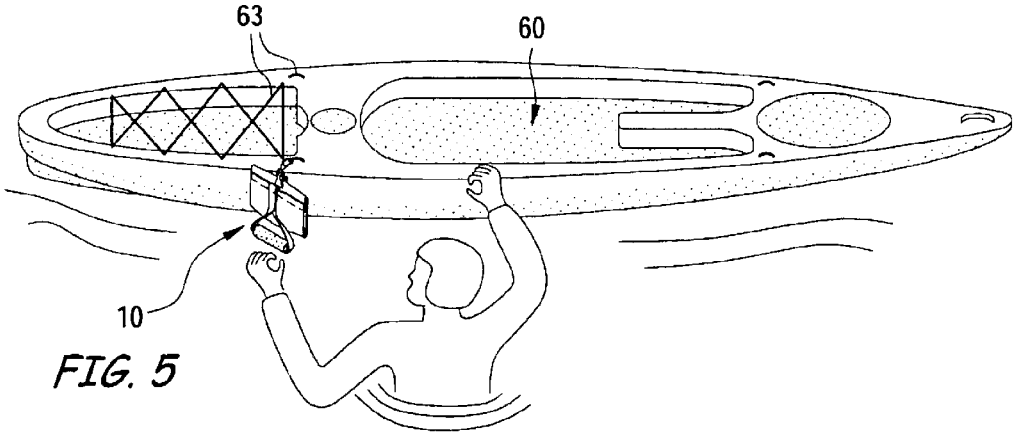
FIG. 5 is a perspective view of an embodiment of the present invention, in its closed, retracted configuration, attached to a kayak, with a kayaker in position to grab the step.
Figure 6:
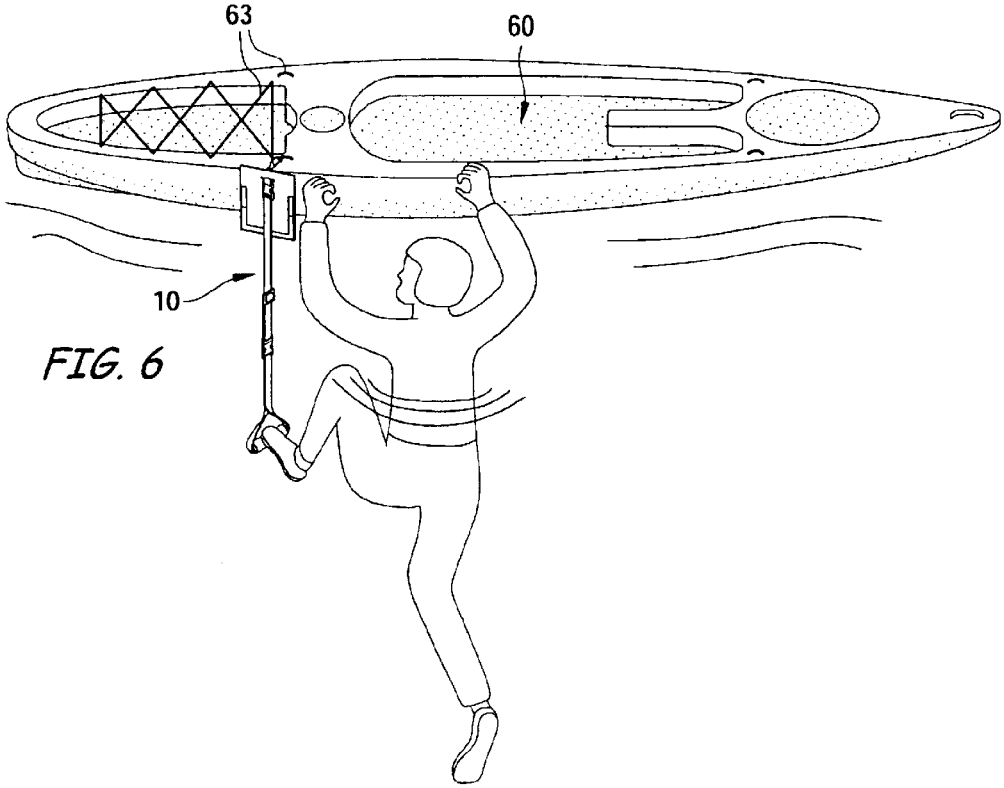
FIG. 6 is a perspective view of embodiment shown in FIG. 5, in its open, extended configuration, with the kayaker having put his foot in place on the step and preparing to board the vessel.

The device is shown in use in FIGS. 5–6. FIG. 5 illustrates the stowable and extendable step 10, in a closed configuration, attached to a vessel (shown as a sea kayak) with a user in the water in position to use the step to re-enter the vessel. The user grasps and pulls on the step 20, causing the strap 30 to extend. Then as shown in FIG. 6, the user guides the step 20 to his foot, grabs onto the vessel, steps against the step 20 and is in position and able to lift himself into the boat. As the person bears his weight on and pushes against the step, the vessel rolls laterally towards the person and thus allows the user to easily enter the vessel.

As noted, the step 20 acts as both a handle and step. It may be constructed of any suitable material that will allow a user to grasp it and also support the user as he reenters the boat. The step 20 may even simply be a loop in the end of the strap 30. As shown, the step 20 is a rigid, tubular step through which the strap 30 passes. The step may have a foam or polymer grip to improve ergonomics and reduce slippage in the water. Further, the step 20 may be constructed such that it floats. In that way, if a user were to let go of the step 20 after pulling it out of the keeper 40, the user may easily locate the step floating on the surface of the water. The step 20 may have the word "PULL" or other text written on it. The step and the word may be of any desirable color, and it has been found that a bright red or orange step, with contrasting and reflective print or highlights, is helpfull in easily seeing and locating the step either on the vessel or in the water.

The strap 30 may be constructed of any suitably strong and durable material, capable of maintaining its strength and longevity in a wet environment. Commonly available nylon webbing is adequate. The strap 30 may include quick-release buckles 33 as a safety measure in case the need arises to quickly separate the step or strap from the vessel. Quick-release buckles 33 may be placed anywhere along the strap, and in particular it has been found helpful to place one near the upper end so that it is positioned just below the slot 43 when the keeper is open, or at the lower end closer to the step 20, or in both positions. In this way, a quick-release buckle 33 is visible and accessible whether the keeper is in an open or closed configuration, and whether the strap 30 is stowed or extended. In addition to safety concerns, the buckles 33 allow the easy replacement of the strap, the handle, or both. The strap 30 may also include an adjustment clip 35 so that the length of the strap may be customized to a particular user or vessel. As with the step 20, the strap 30 may be of any desirable color and include reflective highlights to facilitate its visibility.

The keeper 40 may be constructed of any suitably strong and durable material, capable of folding and unfolding easily without weakening, and of maintaining its strength and longevity in a wet environment. The keeper 40 is illustrated as a single substantially planar piece of material, in a rectangular form. Durable nylon fabric or heavy-duty vinyl is suitable. Being constructed of a single piece of fabric, with no seams, lends strength and durability to the design. The keeper may be of any suitable shape, polygonal, circular, or irregular, depending on the needs and preferences of a user or a particular application. Like the other components of the device, the keeper may be of any desirable color and may include reflective highlights. Further, the keeper may be constructed to comprise some amount of hydrophobic foam or low density material such that it floats. Depending on the intended environment or use, for example in an industrial or commercial application, the keeper could be constructed from two pieces of metal (e.g., stainless steel or aluminum), with a sprung hinge to allow opening and closing and release of the strap.

Instructions 49 may be printed, sewn to, or otherwise attached on the keeper 40, as show in FIG. 1. The interlocking fasteners 42 and 46 are shown in FIG. 1 to be a hook-and-loop type fastener (Velcro). Other interlocking fasteners, such as snaps, buttons, and the like, could be used, though these are not as durable or easy to use as Velcro. Similarly, the fasteners need not be disposed along the entire perimeter of the keeper 40.

Figure 3:
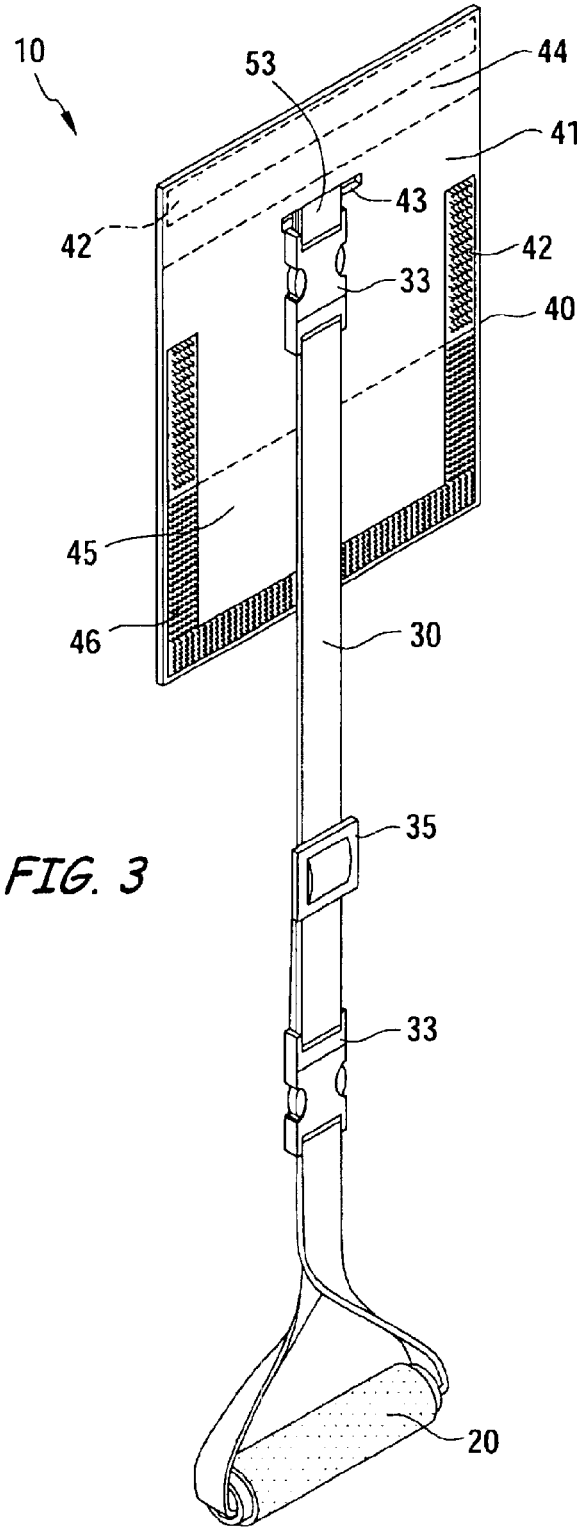
FIG. 3 is a perspective view of a second embodiment of the present invention, with the strap extended and the keeper in an open configuration.
Figure 4:
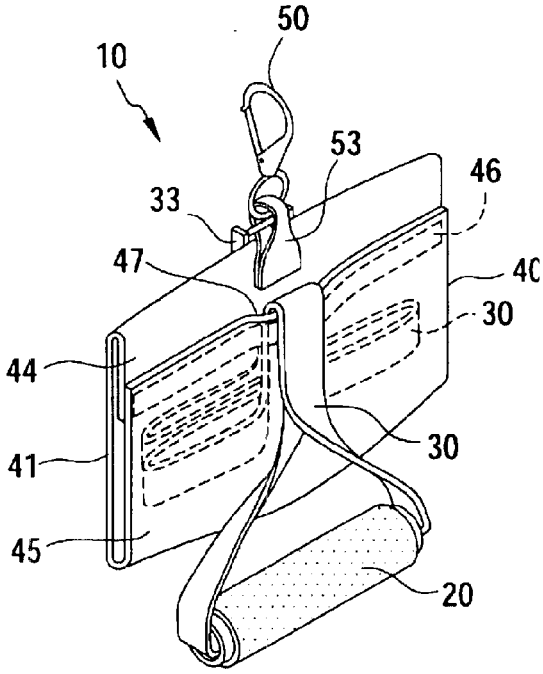
FIG. 4 is the embodiment of FIG. 3 with the strap and the keeper in a closed, stowed configuration.

Another embodiment of the present invention is illustrated in FIGS. 3–4. As shown in FIG. 3, the upper area 41 of the keeper 40 includes a top section 44, which has releasable fasteners 42 on its back side. Top section 44 is folded down, and then lower area 45 is folded up and into contact with the top section 44, such that the interlocking fasteners 42 and 46 engage and secure the keeper in the enclosed configuration shown in FIG. 4. The other features and aspects of the first embodiment, described above, may be applied to the embodiment shown in FIGS. 3–4.

In either embodiment, the keeper 40 could be constructed without a slot 43, and the strap 30 could be sewn or otherwise attached directly to keeper 40. Attachment of the upper end of the strap 30 to the lower area 45 of the keeper 40 would facilitate the opening of the keeper 40 when the strap was pulled by a user. In this variation, the keeper 40 is attached (via a loop 53 and clasp 50 or similar means) to the vessel.

The portable, stowable step 10 thus described and illustrated provides an easy to-use, readily accessible way for almost any person to enter a vessel, such as a kayak, from the water. In addition, an overboard person can simply hold onto the step to prevent being separated from the vessel. This device thus makes boating safer and more enjoyable for individuals, especially those with disabilities, who would otherwise be unable to regain entry into the vessel from the water. Further, the device is lightweight and portable, and thus may easily be moved from one vessel to another. It may be used on virtually any type of watercraft, including kayaks, ocean kayaks, canoes, ski boats, fishing boats, sailboats, party or pontoon boats, life boats, white-water rafts and other rafts, and any other vessel to which the step 10 may be secured.

Although the present invention has been described and shown in considerable detail with reference to certain preferred embodiments thereof, other embodiments are possible. The foregoing description is therefore considered in all respects to be illustrative and not restrictive. Therefore, the present invention should be defined with reference to the claims and their equivalents, and the spirit and scope of the claims should not be limited to the description of the preferred embodiments contained herein.

I claim:

1. A step for boarding a vessel from the water, said step comprising:

a support;

a strap with an upper end and a lower end, the lower end attached to the support; and a keeper comprising a substantially planar foldable piece of material having an upper area and a lower area, said keeper further comprising:

a slot in the upper area, the upper end of the strap extending therethrough for attachment to said vessel; and releasable fasteners attached to at least a portion of the perimeter of said upper and lower areas, the fasteners on the upper area adapted to interlock with those on the lower area;

such that the keeper may be folded to interlock the lower fasteners to the upper fasteners, whereby the interlocked fasteners and the fold thus formed at the bottom of the keeper make an enclosure in which the strap may be gathered with said support hanging from the upper junction of said upper and lower areas, whereby said support when pulled will cause said strap to extend from said enclosure.

2. The step of claim 1, wherein said support floats.

3. The step of claim 1, further comprising a clasp, for attachment to a vessel, the upper end of said strap being attached to said clasp.

4. The step of claim 1, further comprising a loop attached to the back of said upper area above said slot and a clasp, the upper end of the strap and the clasp being attached to said loop.

5. The step of claim 4, further comprising a releasable buckle near the upper end of the strap.

6. The step of claim 1, wherein said strap further comprises a releasable buckle.

7. The step of claim 6, wherein said releasable buckle is located near the lower end of said strap to facilitate replacement of said handle.

8. The step of claim 6, wherein said strap further comprises an adjustment clip to allow the length of said strap to be changed.

9. The step of claim 6, wherein said releasable buckle is located near the upper end of said strap and below said slot such that said buckle is visible when said keeper is in an open configuration and said strap is extended.

10. The step of claim 1, wherein the keeper further comprises printed instructions.

11. The step of claim 1, wherein said releasable fasteners are hook-and-loop fasteners.

12. The step of claim 1, wherein the upper area of said keeper further comprises a top section, said top section being adapted to fold downward, the top section having releasable fasteners on its back side which when so folded are brought into position for interlocking with the fasteners of the lower area.

13. The step of claim 12, further comprising a loop attached to the back of said upper area above said slot and a clasp, the upper end of the strap and said clasp being attached to said loop.

14. The step of claim 13, further comprising a releasable buckle near the upper end of the strap.

15. The step of claim 12, wherein the keeper further comprises printed instructions.

16. The step of claim 12, wherein said releasable fasteners are hook-and-loop fasteners.

17. The step of claim 12, wherein said support floats.

18. The step of claim 12, wherein said strap comprises releasable buckles and an adjustment clip.

19. The step of claim 1, wherein said keeper is made from a single piece of material.

20. A step for boarding a vessel from the water, said step comprising:

a support;

a strap with an upper end and a lower end, the lower end attached to the support; and a keeper made of a substantially planar foldable piece of material, having an upper area and a lower area with releasable fasteners attached to at least a portion of the perimeter of said upper and lower areas, the fasteners on the upper area adapted to interlock with those on the lower area, the upper end of said strap attached to said keeper;

such that the keeper may be folded to interlock the lower fasteners to the upper fasteners, whereby the interlocked fasteners and the fold thus formed at the bottom of the keeper make an enclosure in which the strap may be gathered with said support hanging from the upper junction of said upper and lower areas, whereby said support when pulled will cause said strap to extend from said enclosure.

21. The step of claim 20, wherein said strap is attached to the lower area of said keeper.

22. The step of claim 20, further comprising a loop attached to the back of said upper area and a clasp, said clasp being attached to said loop.

23. The step of claim 20, wherein the keeper further comprises printed instructions.

24. The step of claim 20, wherein said releasable fasteners are hook-and-loop fasteners.

25. The step of claim 20, wherein said support floats.

26. The step of claim 20, wherein said strap comprises a releasable buckle and an adjustment clip.

27. A stowable step for boarding a vessel from the water, said step comprising:

a support;

a strap with an upper end and a lower end, the lower end attached to the support; and a keeper made of a substantially planar foldable piece of material, having an upper area and a lower area with releasable fasteners attached to at least a portion of the perimeter of said upper and lower areas, the fasteners on the upper area adapted to interlock with those on the lower area;

means for attaching the upper end of said strap and said keeper to said vessel; such that the keeper may be folded to interlock the lower fasteners to the upper fasteners, whereby the interlocked fasteners and the fold thus formed at the bottom of the keeper make an enclosure in which the strap may be gathered with said support hanging from the upper junction of said upper and lower areas, whereby said support when pulled will cause said strap to extend from said enclosure.

* * * * *